US006682320B2

(12) United States Patent
Gold et al.

(10) Patent No.: US 6,682,320 B2
(45) Date of Patent: Jan. 27, 2004

(54) ELECTRIC FAN

(75) Inventors: Matthias Gold, Bad Urach (DE); Dirk Herke, Nuertingen (DE); Frank Hoenig, Deizisau (DE)

(73) Assignee: AFL Germany Electronics GmbH, Frickenhausen (DE)

( * ) Notice: Subject to any disclaimer, the term of this patent is extended or adjusted under 35 U.S.C. 154(b) by 0 days.

(21) Appl. No.: 10/139,997

(22) Filed: May 6, 2002

(65) Prior Publication Data

US 2002/0187059 A1 Dec. 12, 2002

Related U.S. Application Data

(63) Continuation of application No. PCT/EP01/09921, filed on Aug. 29, 2001.

(30) Foreign Application Priority Data

Sep. 7, 2000 (DE) ..... 100 44 066

(51) Int. Cl.[7] ..... F04B 39/06
(52) U.S. Cl. ..... 417/368; 417/423.8; 310/62
(58) Field of Search ..... 417/366, 368, 417/423.8

(56) References Cited

U.S. PATENT DOCUMENTS 4,883,982 A 11/1989 Forbes et al.
5,944,497 A * 8/1999 Kershaw et al. ..... 417/423.8
5,967,764 A * 10/1999 Booth et al. ..... 417/423.8
6,236,129 B1 * 5/2001 Yamashita ..... 310/90
6,384,494 B1 * 5/2002 Avidano et al. ..... 310/58

FOREIGN PATENT DOCUMENTS

| | | |
|---|---|---|
| DE | 90 12 087 | 2/1992 |
| DE | 42 34 017 | 4/1993 |
| DE | 195 46 040 | 6/1996 |
| JP | 2001-132698 | * 5/2001 |

OTHER PUBLICATIONS

*Patent Abstracts of Japan*, Abstract of Japanese Patent "Motor Fan Control Device for Vehicle", Publication No. 03264723, Nov. 26, 1991, Japanese Application No. 02062186, Filed Mar. 13, 1990.

* cited by examiner

*Primary Examiner*—Charles G. Freay
(74) *Attorney, Agent, or Firm*—Barry R. Lipsitz; Douglas M. McAllister

(57) ABSTRACT

The invention relates to an electric fan, in particular, for motor vehicles, comprising an electric drive motor, a fan wheel coupled with the drive motor, and an electronic control unit for controlling the motor. In order to make the electric fan structurally more simple and more cost-effective to assemble, it is proposed that the drive motor and the control unit be arranged in a common housing, and that the housing have air vents for passage of a flow of cooling air generatable by the fan wheel, and a heat sink of the control unit be arranged at at least one air vent.

21 Claims, 3 Drawing Sheets

ELECTRIC FAN

This application is a continuation of international application number PCT/EP01/09921 filed on Aug. 29, 2001.

The present disclosure relates to the subject matter disclosed in international application No. PCT/EP01/09921 of Aug. 29, 2001, which is incorporated herein by reference in its entirety and for all purposes.

BACKGROUND OF THE INVENTION

The invention relates to an electric fan, in particular, for motor vehicles, comprising an electric drive motor, a fan wheel coupled with the drive motor, and an electronic control unit for controlling the drive motor.

Such electric fans are used, in particular, for cooling the drive units of a motor vehicle. Herein, a flow of air oriented substantially parallel to the axis of rotation of the fan wheel is generated by the fan wheel and directed, for example, at a radiator unit of the motor vehicle.

In order to achieve optimum cooling with as little energy as possible, the rotational speed of the fan wheel can be set in accordance with the respective cooling requirement. A control unit is normally used for this purpose. This is coupled with the drive motor and enables power-controlled operation of the drive motor. To this end, the control unit usually comprises a control circuit which generates a PWM signal, i.e., a pulse-width-modulated signal for controlling a power output stage, usually in the form of at least one FET output stage switch.

The control unit is usually connected via connection cables to the drive motor and arranged in a separate housing.

The object of the present invention is to make an electric fan of the kind mentioned at the outset structurally more simple and more cost-effective to assemble.

SUMMARY OF THE INVENTION

This object is accomplished with a fan of the generic kind in accordance with the invention in that the drive motor and the control unit are arranged in a common housing, and in that the housing has air vents for passage of a flow of cooling air generatable by the fan wheel, and a heat sink of the control unit is arranged at at least one air vent.

In accordance with the invention, the drive motor and the control unit form a common structural unit. This has the advantage that there is a significantly lower space requirement for the electric fan. Moreover, the electric fan is characterized by very good electromagnetic compatibility, as the control unit is arranged immediately adjacent to the electric motor and is surrounded together with it by a housing, with the aid of which an emission of electromagnetic interference is reliably preventable, as is also an influencing, in particular, of the electronic control unit by external electromagnetic radiation fields.

A further advantage of the design according to the invention is that a separate power supply line between the control unit and the drive motor is dispensed with. This power supply line is a main cause of electromagnetic interference. In addition, the compact design of the electric fan simplifies its handling and results in reduced susceptibility.

In accordance with the invention, provision is made for a flow of cooling air to be generatable by the fan wheel and to be passable through air vents of the housing. Heat dissipation is thereby ensured, so that in spite of the arrangement of the control unit and the drive motor in a common housing, reliable operation is guaranteed. Here provision is made in accordance with the invention for a heat sink of the control unit to be arranged at at least one air vent of the housing. The heat sink is thus directly exposed to the flow of cooling air generatable by the fan wheel, so that, in particular, the control unit does not undergo inadmissible heating during operation of the electric fan. The arrangement of the heat sink at an air vent of the housing makes it possible for the heat sink to be targeted with a flow of cooling air.

The arrangement of the at least one heat sink at an air vent of the housing also ensures that the flow of air generated by the fan wheel and oriented substantially parallel to the axis of rotation of the fan wheel remains uninfluenced by the cooling of the drive motor and the control unit. The flow of air can thus be used completely for cooling, for example, a drive unit of a motor vehicle without coming into contact with cooling elements of the drive motor or the control unit, which would result in a heating of the flow of air and hence in a reduction of the effective cooling performance of the fan. Moreover, the flow of air is not impeded, for example, deflected or partly faded out by cooling elements of the drive motor or the control unit. Instead, a separate flow of cooling air is used for cooling the control unit and the drive motor and like the flow of air provided for cooling external units, this is generated by the fan wheel but extends mainly inside the housing.

A particularly effective cooling of the housing interior is achievable in an advantageous design by the flow of cooling air having a flow section extending inside the housing and oriented substantially coaxially with the axis of rotation of the fan wheel. For example, provision may be made for the flow section oriented coaxially with the axis of rotation to pass virtually through the complete housing in the longitudinal direction thereof, so that both the electronic control unit and the drive motor are subjected to the flow of cooling air and thereby effectively cooled.

Alternatively and/or additionally thereto, provision may be made for the flow of cooling air to have a flow section inside the housing which is oriented substantially radially in relation to the axis of rotation of the fan wheel. This enables, in particular, guidance of the flow of cooling air inside the housing in such a way that the flow of cooling air enters and/or leaves the housing radially, to extend substantially coaxially with the axis of rotation of the fan wheel inside the housing.

It is of advantage for at least one heat sink to be arranged in the area of the radially oriented flow section of the flow of cooling air. In relation to the axis of rotation of the fan wheel this enables a particularly short structural design of the electric fan, as the heat sink can be arranged at the same level as the housing in relation to the axis of rotation.

In a particularly preferred embodiment of the fan according to the invention, provision is made for at least one heat sink to be arranged in the area of an air inlet opening through which the flow of cooling air is conducted into the housing interior. A particularly effective cooling of the heat sink and hence also of the electric components of the control unit thermally connected thereto is thereby ensured as the flow of cooling air is at its lowest temperature when entering the housing interior.

Alternatively and/or additionally thereto, provision may be made for at least one heat sink to be arranged in the area of an air outlet opening through which the flow of cooling air is conducted out of the housing interior. In such an embodiment, the flow of cooling air can first come into contact with the drive motor and the electric components of the control unit inside the housing and then pass over the heat sink at it exits from the housing.

As explained hereinabove, the heat sink is preferably arranged at an air vent which is arranged on a wall area of the housing surrounding the drive motor and the control unit in a circumferential direction.

It is expedient for the heat sink to have cooling fins, the surface normal of which is oriented substantially perpendicularly to the axis of rotation of the fan wheel. The cooling fins are preferably oriented parallel to one another and receive the flow of cooling air between them.

To ensure a particularly large contact surface between the drive motor and the flow of cooling air, provision is made in a preferred embodiment of the invention for at least one heat sink to be arranged at an air vent positioned adjacent to an end wall of the housing, and for the housing to have a further air vent in its end area remote from the end wall. This makes it possible for the flow of cooling air to pass through virtually the complete housing in the longitudinal direction thereof. Here it is particularly expedient for the heat sink to be arranged at an air inlet opening of the housing as this ensures a particularly effective cooling, in particular, of the control unit.

To generate the flow of cooling air, provision may be made for the fan wheel to generate a excess pressure or a negative pressure inside the housing by the housing being supplied with cooling air from the fan wheel or by a negative pressure being generated in the area of an air vent, which results in a suction current through the housing.

A design has proven particularly advantageous wherein the housing has an air outlet opening adjacent to the fan wheel, and the flow of cooling air in the area of this air outlet opening is settable in rotation around the axis of rotation of the fan wheel. During the rotational movement the flow of cooling air is subjected to a radially outwardly oriented force of inertia (centrifugal force), so that starting from the air outlet opening arranged adjacent to the fan wheel the cooling air is whirled outwardly at an incline. As a result of this, a negative pressure forms in the area of the air outlet opening, and to achieve a pressure compensation a suction current forms inside the housing in the direction towards the air outlet opening, which ensures effective cooling of both the control unit and the drive motor.

The rotational movement of the flow of cooling air can be created in a structurally particularly simple and cost-effective way by the fan wheel having lamellae arranged adjacent to the air outlet opening for moving the flow of cooling air around the axis of rotation. The lamellae are preferably oriented transversely to the direction of rotation of the fan wheel.

In order to create a particularly strong flow of cooling air inside the housing, it is of advantage for the air outlet opening to form an annular gap oriented coaxially with the axis of rotation of the fan wheel. This makes it possible to conduct the flow of cooling air out of the housing interior with uniform distribution over the entire extent of the housing, thereby enabling all areas of the housing interior to be uniformly cooled.

The housing can, for example, comprise a preferably U-shaped housing pot and a cover-type base plate, with the annular gap being delimited, on the one hand, by the housing pot and, on the other hand, by the base plate. Here it is particularly advantageous for the housing pot and the base plate to be held so as to be rotatable relative to each other. For example, provision may be made for the housing pot to be mounted for rotation on the base plate and for the fan wheel to be held on the housing pot. Such a design has proven its worth, in particular, when an electronically commutated fan motor is used as drive motor. Here the housing pot forms a magnetic loopback for permanent magnets secured inside the housing on the housing pot, and the housing pot also forms a hub for the fan wheel, which is rotationally fixedly held on the housing pot and surrounds the housing pot in a circumferential direction. The rotation of the housing pot results in the cooling air flowing through the housing in the area of the annular gap being set in rotation, and as a result of the centrifugal force thus created, the flow of cooling air in the area of the annular gap between the housing pot and the base plate is whirled outwards at an incline. A negative pressure is thus generated in the area of the annular gap. For pressure compensation, air inlet openings can, for example, be provided in a bottom wall of the housing pot and/or in the area of the base plate so as to form a flow of cooling air which passes through the housing interior.

The electronic control unit usually comprises a large number of electronic components secured to a printed circuit board. The printed circuit board is preferably arranged inside the housing such that the flow of cooling air passes over at least a partial area of the printed circuit board. It is of particular advantage for the printed circuit board to be arranged so as to be oriented transversely to the axis of rotation of the fan wheel in the area of a radial flow section of the flow of cooling air. Provision may, for example, be made for the printed circuit board to be oriented parallel to an end wall of the preferably cylindrical housing.

A particularly effective cooling of the control unit can be ensured by the printed circuit board being held on the heat sink, which extends into an air vent of the housing. Here it is expedient for the printed circuit board to be of ring-shaped design, with the heat sink held at the outer edge of the printed circuit board. In such an embodiment, the flow of cooling air can be supplied directly to the heat sink arranged at the outer edge of the printed circuit board, and as the printed circuit board is thermally coupled with the heat sink, a reliable cooling of the printed circuit board and the electronic components of the control unit attached thereto is thereby achievable.

The following description of two preferred embodiments of the invention serves in conjunction with the drawings to explain the invention in greater detail.

DETAILED DESCRIPTION OF THE INVENTION

Figure 1:
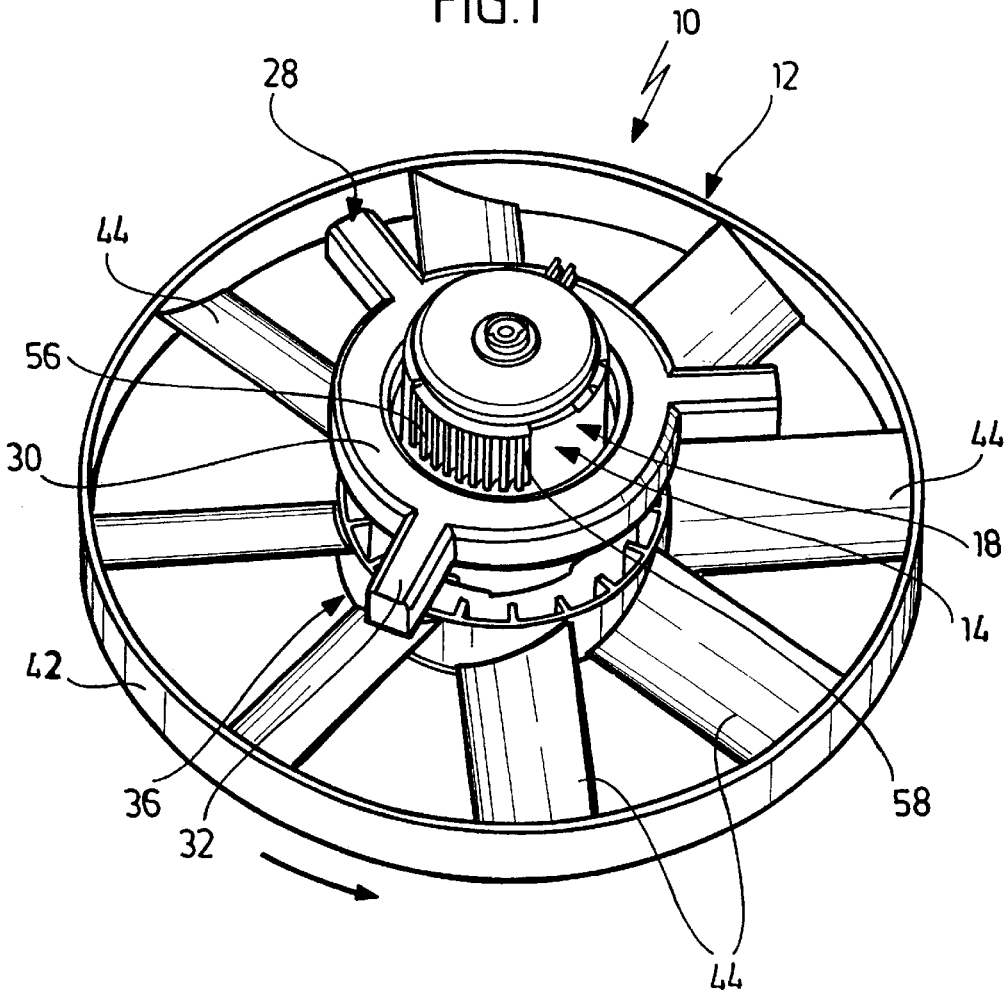
FIG. 1 is a perspective representation of a first embodiment of an electric fan according to the invention.
Figure 2:
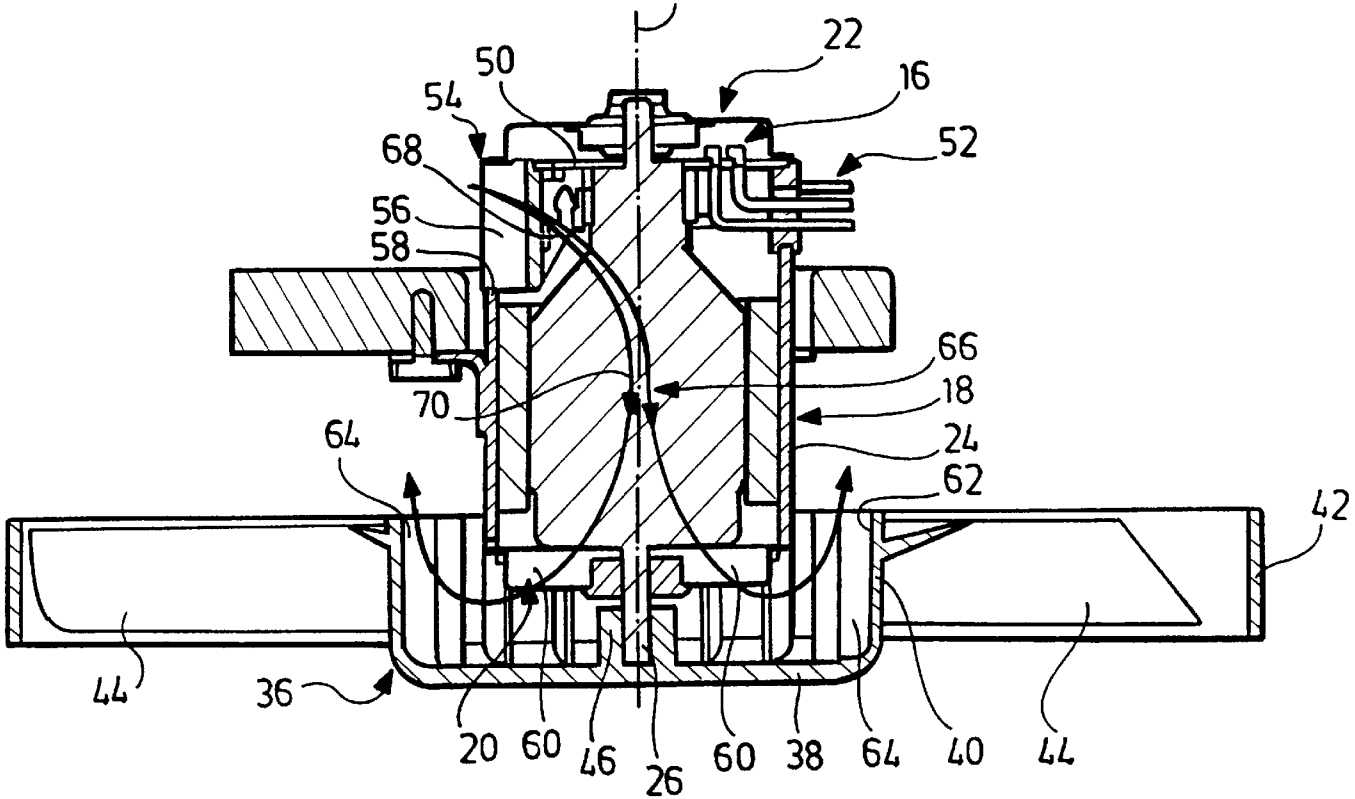
FIG. 2 is a sectional representation of the electric fan shown in FIG. 1.

FIGS. 1 and 2 show in diagrammatic representation a first form of an electric fan generally designated by reference numeral 10. Such fans are used, in particular, in motor vehicles and are positioned inside the engine compartment on a radiator unit so as to allow a flow of air generated by the fan 10 to be directed onto the radiator unit. The electric fan 10 comprises in the usual way a fan wheel 12 and a fan motor 14, which is shown only diagrammatically in the drawings and is known per se. The fan 10 further comprises an electronic control unit 16 arranged together with the fan motor 14 in a substantially cylindrical housing 18. The housing 18 has a front bearing cover 20 facing the fan wheel 12 and a rear bearing cover 22 facing away from the fan wheel 12, which close off at the end faces a housing jacket 24 enclosing the control unit 16 and the fan motor 14 in a circumferential direction. The front bearing cover 20 and the rear bearing cover 22 each form a bearing for a motor shaft 26 protruding from the front bearing cover 20.

The housing 18 is held on a fan star 28 comprising a holding ring 30 surrounding the housing jacket 24 in a circumferential direction. Three holding arms 32 protrude in the shape of a star from the holding ring 30 and with their free ends, not shown in the drawings, can be secured stationarily in the engine compartment of the motor vehicle.

The fan wheel 12 is designed as an axial fan and comprises a fan pot 36 engaging over the front bearing cover 20 of the housing 18. The fan pot 36 of essentially U-shaped design comprises a bottom wall 38 oriented transversely to the motor shaft 26 and a side wall 40 integrally connected to the bottom wall 38. The side wall 40 is in the form of a cylinder jacket with a cylinder axis oriented coaxially with the motor shaft 26.

At a radial spacing from the side wall 40, the fan wheel 12 has an outer ring 42 oriented coaxially with the side wall 40, and a plurality of fan blades 44 oriented radially in relation to the motor shaft 26 extend between the side wall 40 and the outer ring 42.

Facing the front bearing cover 20, a sleeve 46 is formed on the bottom wall 38 of the fan pot 36, via which the fan wheel 12 is rotationally fixedly connected to the fan motor 14 so that the fan wheel is rotatable about the axis of rotation 48 defined by the motor shaft 26.

The electric control unit 16 arranged inside the housing 18 is provided for power-controlled operation of the fan motor 12. It comprises a circular ring-shaped printed circuit board 50 which is held on the rear bearing cover 22 inside the housing 18 and surrounds the axis of rotation 48 in a circumferential direction. A large number of electronic components are held in a manner known per se and, therefore, not shown in the drawings, on the printed circuit board 50, in particular, an electronic control device for generating pulse-width-modulated control signals and an electronic power device with several FET output stage switches, as known, for example, from German laid-open print DE 197 02 949 A1. The electronic components secured to the printed circuit board 50 are connected via connection lines 52 led out of the housing 18 to a power supply and to a control device, for example, a central engine management system of a motor vehicle. The printed circuit board 50 of the control unit 16 is held on a metallic heat sink 54 which, in turn, is secured to the rear bearing cover 22 and has a plurality of cooling fins 56. The cooling fins 56 pass through an air inlet opening 58 formed in the housing jacket 24 and arranged adjacent to the rear bearing cover 22. Corresponding air outlet openings 60 are provided on the front bearing cover 20.

The side wall 40 of the fan pot 36 carries on its inner side 62 facing the front bearing cover 20 several lamellae 64 oriented perpendicularly to the side wall 40 and spaced equidistantly from one another. When the fan wheel 12 is set in rotational motion by the fan motor 14, the air inside the fan pot 36 is set in rotation owing to the lamellae oriented transversely to the direction of rotation of the fan wheel 12. This rotational motion, in turn, causes a centrifugal force to act upon the air, with the result that the air is whirled outwards at an incline. A negative pressure is thus generated inside the fan pot 36 in the area of the air outlet openings 60 arranged on the front bearing cover 20, and, as a result of this negative pressure, air is drawn in by suction through the air inlet opening 58. A flow of cooling air 66 is thus formed inside the housing 18, and starting from the air inlet opening 58, it is first oriented substantially radially in relation to the axis of rotation 48 and forms a radial flow section 68 adjacent to the printed circuit board 50. In the direction of the front bearing cover 20, the flow of cooling air 66 then passes over into a substantially axially oriented flow section 70 and passes out of the housing 18 through the air outlet openings 60.

The cooling fins 56 of the heat sink 54 are arranged inside the air inlet opening 58 and the flow of cooling air 66 therefore flows through them. This results in effective cooling of the heat sink 54 and the printed circuit board 50 of the electronic control unit 16 which is secured thereto. The fan motor 14 is also effectively cooled, as the flow of cooling air 66 acts upon it virtually along its entire length. In spite of integration of the fan motor 14 and the electronic control unit 16 in the housing 18, an overheating of the electric fan is thus reliably prevented.

Figure 3:
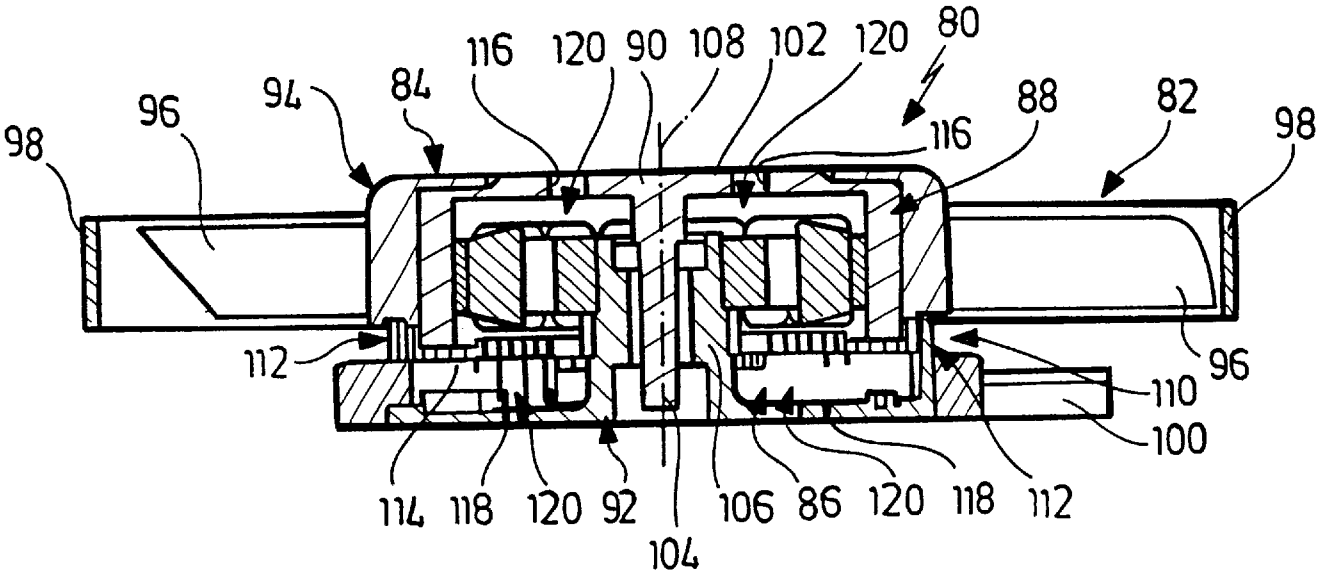
FIG. 3 is a sectional representation of a second embodiment of an electric fan according to the invention.

FIG. 3 shows an alternative embodiment in the form of an electric fan 80 with a fan wheel 82, a fan motor 84 and an electronic control unit 86. The fan motor 84 and the control unit 86 are arranged in a common housing 88 which is formed by a housing pot 90 and a base plate 92 covering the housing pot 90 at a distance therefrom. A fan pot 94 of the fan wheel 82 is rotationally fixedly placed on the housing pot 90 and in accordance with the design of the fan wheel 12 described with reference to FIGS. 1 and 2 a plurality of radially oriented fan blades 96 connected to one another at their radially outward end via a holding ring 98 are also held on the fan pot 94 of the fan wheel 82.

The fan motor 84 is designed as an electronically commutated electric motor, and the housing pot 90 constitutes a magnetic loopback for the magnetic circuit formed inside the fan motor 84. The housing pot 90 is mounted for rotation on the base plate 92 which is held stationarily by means of a fan star 100. A bearing journal 104 facing the base plate 92 is arranged in the area of a bottom wall 102 of the housing pot 90 to enable the rotatable mounting. The bearing journal 104 is held for rotation on a bearing sleeve 106 which is secured to the base plate 92. The bearing journal 104 defines an axis of rotation 108 of the fan wheel 82.

The housing pot 90 and the base plate 92 are arranged in spaced relation to each other in their radially outward lying area so that an annular gap 110 oriented coaxially with the axis of rotation 108 is formed between the two components. A plurality of cooling pins 112 oriented parallel to the axis of rotation 108 and secured to the base plate 92 extend into the annular gap 110. In their entirety, these form a heat sink.

Facing the housing pot 90, the base plate 92 carries a printed circuit board 114 of the control unit 86. The electronic components are arranged in the usual way on the printed circuit board 114, as explained hereinabove with reference to the printed circuit board 50 shown in FIGS. 1 and 2.

The bottom wall 102 of the housing pot 90 comprises several air inlet openings 116, and further air inlet openings 118 are provided in the base plate 92.

When the housing pot 90 and the fan pot 94 are set in rotational motion by the fan motor 84, this results in the air being rotated about the axis of rotation 108, in particular, in the area of the annular gap 110. This, in turn, causes the air be whirled outwards at an incline owing to the centrifugal force acting on it, so that a negative pressure is formed in the area of the annular gap 110. Cooling air is, therefore, drawn in substantially in axial direction into the interior of the housing 88 through the air inlet openings 116 and 118. In the area of the printed circuit board 114 the cooling air is conducted radially outwardly in the direction towards the annular gap 110 and through this, so that altogether a flow of cooling air 120 is formed inside the housing 88, thereby ensuring a reliable removal of the waste heat generated by the fan motor 84 and the control unit 86.

The electric fans 10 and 80 are characterized by a compact design, and electromagnetic interference is prevented owing to the integration of the control unit 16 and 86, respectively, into the housing of the fan motor 14 and 84. An overheating of the electric fans 10 and 80 can be reliably prevented by the flow of cooling air created by the fan wheel 12 and 82, respectively.

What is claimed is:

1. An electric fan for use in motor vehicles, comprising:

an electric drive motor, a fan wheel coupled with the drive motor, an electronic control unit for controlling the drive motor, a common housing for the drive motor and the control unit, said housing having air vents for passage of a flow of cooling air generatable by the fan wheel, and a heat sink of the control unit arranged at an air vent arranged on a wall area surrounding the drive motor and the control unit in a circumferential direction.

2. Fan in accordance with claim 1, wherein the flow of cooling air has a flow section extending inside the housing and oriented substantially coaxially with the axis of rotation of the fan wheel.

3. Fan in accordance with claim 1, wherein the flow of cooling air has a flow section oriented substantially radially in relation to the axis of rotation of the fan wheel.

4. Fan in accordance with claim 2, wherein at least one heat sink is arranged in the area of the radially oriented flow section.

5. Fan in accordance with claim 1, wherein at least one heat sink is arranged in the area of an air inlet opening through which the flow of cooling air is conveyed into the housing interior.

6. Fan in accordance with claim 1, wherein at least one heat sink is arranged in the area of an air outlet opening through which the flow of cooling air is conveyed out of the housing interior.

7. Fan in accordance with claim 1, wherein the control unit comprises a printed circuit board, and the flow of cooling air passes over at least a partial area of the printed circuit board.

8. Fan in accordance with claim 7, wherein the printed circuit board is arranged in the area of a radial flow section of the flow of cooling air and is oriented transversely to the axis of rotation of the fan wheel.

9. An electric fan for use in motor vehicles, comprising:

an electric drive motor, a fan wheel coupled with the drive motor, an electronic control unit for controlling the drive motor, a common housing for the drive motor and the control unit, said housing having air vents for passage of a flow of cooling air generatable by the fan wheel, and a heat sink of the control unit arranged at at least one air vent, the heat sink comprising cooling fins, the surface normal of which is oriented substantially perpendicularly to the axis of rotation of the fan wheel.

10. An electric fan for use in motor vehicles, comprising:

an electric drive motor, a fan wheel coupled with the drive motor, an electronic control unit for controlling the drive motor, a common housing for the drive motor and the control unit, said housing having air vents for passage of a flow of cooling air generatable by the fan wheel, and a heat sink of the control unit arranged at an air vent positioned adjacent to an end wall of the housing, the housing having a further air vent in its end area remote from this end wall.

11. An electric fan for use in motor vehicles, comprising:

an electric drive motor, a fan wheel coupled with the drive motor, an electronic control unit for controlling the drive motor, a common housing for the drive motor and the control unit, said housing having air vents for passage of a flow of cooling air generatable by the fan wheel and having an air outlet opening adjacent to the fan wheel, the flow of cooling air in the area of this air outlet opening being directed in rotation around the axis of rotation of the fan wheel, and a heat sink of the control unit arranged at at least one air vent.

12. Fan in accordance with claim 11, wherein the fan wheel has lamellae arranged adjacent to the air outlet opening for moving the flow of cooling air around the axis of rotation.

13. Fan in accordance with claim 11, wherein the air outlet opening forms an annular gap oriented coaxially with the axis of rotation of the fan wheel.

14. Fan in accordance with claim 13, wherein the annular gap is delimited, on the one hand, by a housing pot, and, on the other hand, by a base plate of the housing.

15. Fan in accordance with claim 14, wherein the housing pot is rotatably mounted on the base plate, and the fan wheel is held on the housing pot.

16. Fan in accordance with claim 13, wherein the heat sink comprises cooling elements held in the annular gap.

17. Fan in accordance with claim 16, wherein the cooling elements are of pin-shaped design.

18. Fan in accordance with claim 16, wherein the cooling elements are held on the base plate and are oriented parallel to the axis of rotation of the fan wheel.

19. Fan in accordance with claim 16, wherein the cooling elements are arranged so as to be distributed over the entire annular gap.

20. An electric fan for use in motor vehicles, comprising:

an electric drive motor, a fan wheel coupled with the drive motor, an electronic control unit comprising a printed circuit board for controlling the drive motor, a common housing for the drive motor and the control unit, said housing having air vents for passage of a flow of cooling air generatable by the fan wheel, the flow of cooling air passing over at least a partial area of the printed circuit board, a heat sink of the control unit arranged at at least one air vent, the printed circuit board being arranged in an area of a radial flow section of the flow of cooling air and oriented transversely to the axis of rotation of the fan wheel, and the printed circuit board being held on the heat sink which extends into an air vent.

21. An electric fan for use in motor vehicles, comprising:

an electric drive motor, a fan wheel coupled with the drive motor, an electronic control unit comprising a printed circuit board for controlling the drive motor, the printed circuit board being of ring-shaped design, a common housing for the drive motor and the control unit, said housing having air vents for passage of a flow of cooling air generatable by the fan wheel, the flow of cooling air passing over at least a partial area of the printed circuit board, and a heat sink of the control unit arranged at at least one air vent, and held at the outer edge of the printed circuit board.

* * * * *